US009943160B2

(12) United States Patent
Rojas

(10) Patent No.: US 9,943,160 B2
(45) Date of Patent: Apr. 17, 2018

(54) SELF GROOMING BARBER STATION

(71) Applicant: Gabriel Rojas, Surprise, AZ (US)

(72) Inventor: Gabriel Rojas, Surprise, AZ (US)

(73) Assignee: Gabriel Rojas, Surprise, AZ (US)

( * ) Notice: Subject to any disclaimer, the term of this patent is extended or adjusted under 35 U.S.C. 154(b) by 0 days.

(21) Appl. No.: 15/259,204

(22) Filed: Sep. 8, 2016

(65) Prior Publication Data

US 2018/0064232 A1 Mar. 8, 2018

(51) Int. Cl.

| | |
|---|---|
| ***A45D 42/10*** | (2006.01) |
| ***A45D 44/00*** | (2006.01) |
| ***A45D 44/06*** | (2006.01) |
| ***A45D 42/18*** | (2006.01) |
| ***A45D 44/16*** | (2006.01) |
| ***F21V 33/00*** | (2006.01) |
| *F21W 131/302* | (2006.01) |

(52) U.S. Cl.

CPC ..... *A45D 44/00* (2013.01); *A45D 42/10* (2013.01); *A45D 42/18* (2013.01); *A45D 44/06* (2013.01); *A45D 44/16* (2013.01); *F21V 33/0004* (2013.01); *F21W 2131/302* (2013.01)

(58) Field of Classification Search

CPC ..... A45D 44/00; A45D 44/06; A45D 44/16; A45D 42/10; A45D 42/18; F21V 33/0004

See application file for complete search history.

(56) References Cited

U.S. PATENT DOCUMENTS

| | | | | |
|---|---|---|---|---|
| 4,119,107 A * | 10/1978 | Pinzone | ..... | A45C 5/00 132/316 |
| 7,347,573 B1 * | 3/2008 | Isler | ..... | A45D 42/10 359/854 |
| 2016/0045015 A1 * | 2/2016 | Baldwin | ..... | A45D 42/18 359/854 |

* cited by examiner

*Primary Examiner* — Thomas M Sember

(57) ABSTRACT

A barber station apparatus is disclosed for enhancing the ability of a user to perform self-grooming functions. The apparatus may include a base assembly, an elongated member, a mirror assembly, and a docking assembly. The assemblies may be coupled together in a manner that enables the apparatus to be collapsed for storage and adjusted for different heights and positions of a user. The base assembly may be integrated with an air pump (e.g., vacuum) and may include support elements to support the other assemblies. The elongated member may retract into the base assembly and may be coupled with the docking assembly and the mirror assembly. The docking assembly may include a storage unit for hair grooming devices and the mirror assembly may include multiple interconnected mirrors that can expand around a user to enable the user to have a 360° view of a portion of their body (e.g., head, torso).

20 Claims, 5 Drawing Sheets

SELF GROOMING BARBER STATION

TECHNICAL FIELD

The present disclosure is generally related to a barber station for personal grooming.

BACKGROUND

Individuals often attempt to self-groom by cutting their own hair using an assortment of different devices. The devices may include one or more mirrors, clippers, light sources, vacuums, or other such devices. In order for an individual to cut their own hair, they often utilize multiple mirrors to view different portions of a target area. For example, the individual may use a wall mirror and hold a handheld mirror at an angle that enables the individual to see the back and sides of their head. The individual may also need a location that is near a power source and a location that is well lit. The assortment of devices and other aspects useful for self-grooming may not be readily available or organized in a manner that enables an individual to self-groom.

BRIEF DESCRIPTION OF THE DRAWINGS

The present invention is illustrated by way of example, and not by way of limitation, and will become apparent upon consideration of the following detailed description, taken in conjunction with the accompanying drawings, in which like reference characters refer to like parts throughout, and in which.

DETAILED DESCRIPTION

A barber station apparatus is disclosed herein for enhancing the ability of a user to perform self-grooming functions. The apparatus may include a base assembly, an elongated member, a mirror assembly, and a docking assembly. The assemblies may be coupled together in a manner that enables the apparatus to be collapsed for storage and adjusted for different heights and positions of a user. The base assembly may be integrated with an air pump (e.g., vacuum) and may include support elements to support the other assemblies. The elongated member may retract into the base assembly and may be coupled with the docking assembly and the mirror assembly. The docking assembly may include a storage unit for hair grooming devices and the mirror assembly may include multiple interconnected mirrors that can expand around a user to enable the user to have a 360° view of a portion of their body (e.g., head, torso).

The following description provides various embodiments of a barber station apparatus for personal or professional use. In particular, FIGS. 1-5 provide various illustrations but these illustrations are merely exemplary and illustrate various capabilities of the underlying barber station apparatus. It should be noted that the functionality described herein may be achieved with various configurations, in accordance with embodiments of the present application.

Figure 1:
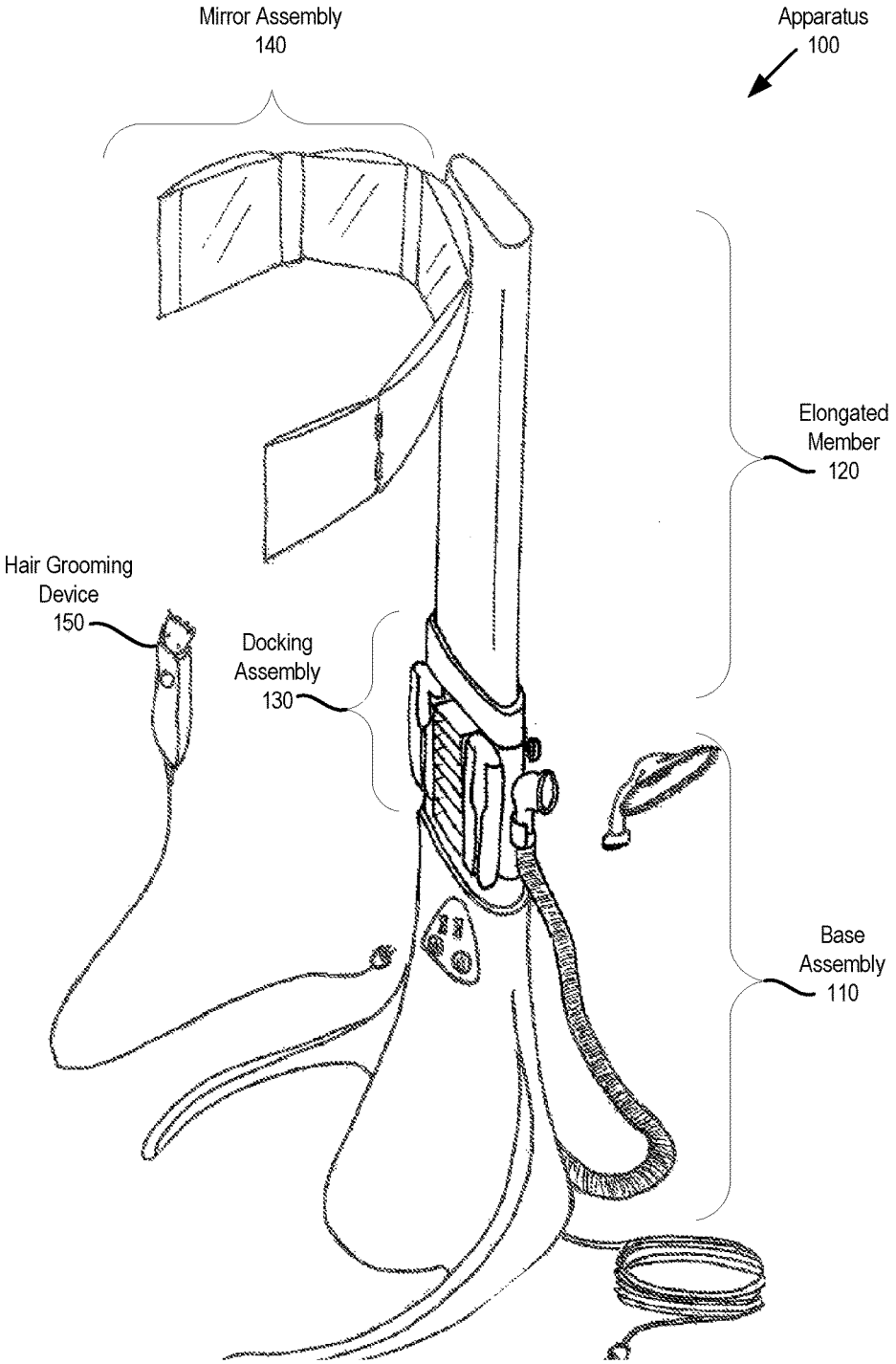
FIG. 1 illustrates an isometric view of an exemplary barber station apparatus in accordance with an embodiment.

FIG. 1 illustrates an isometric view of an exemplary barber station apparatus 100 in accordance with one embodiment. Apparatus 100 may include a base assembly 110, an elongated member 120, a docking assembly 130, and a mirror assembly 140.

Base assembly 110 may any shape or size and may provide support for one or more other assemblies. Base assembly 110 may be designed in a manner that enables it to avoid tipping from the weight of the other assemblies. Base assembly 110 may include a portion for interfacing with a support area (e.g., ground, wall) and a portion for coupling with the elongated member 120. Base assembly 110 may include one or more integrated components such as an integrated air pump (e.g., vacuum) or integrated power source. The integrated power source may provide power to one or more devices via an electrical outlet (e.g., plug), recharging contact, or electromagnetic induction point (e.g., charging pad), or other mechanism to propagate energy. In one example, the integrated power source may receive power using an electrical cord that can be plugged into a wall outlet. In another example, the integrated power source may receive power from another source such as a rechargeable battery, gasoline generator, solar panel, other source or a combination thereof. The portion for coupling with the elongated member 120 may include one or more adjustable units that allow the height of the elongated member 120 to vary. Base assembly 110 will be discussed in more detail in regards to FIG. 2.

Elongated member 120 may be coupled to base assembly 110 and may extend in an upward direction away from the base assembly 110. Elongated member 120 may function as a post element that supports mirror assembly 140, docking assembly 130, other assemblies, or a combination thereof. Elongated member 120 may be made of any material in any shape. The materials may include plastic, metal, wood, other material, or a combination thereof. The shape may be circular, oval, rectangular, other shape, or a combination thereof. As shown in FIG. 1, the elongated member 120 is rectangular with rounded corners. Elongated member 120 is discussed in more detail below in regards to FIG. 3.

Docking assembly 130 may include one or more storage units and be coupled to the elongated member 120, the base assembly, other connection point, or a combination thereof. The storage units may provide an area to store objects and may include storage connection points for holding or suspending one or more hair grooming devices 150. Hair grooming device 150 may include hair cutting devices, hair styling devices, hair drying devices, hair coloring devices, other devices associated with a barber or a combination thereof. Docking assembly 130 will be discussed in more detail in regards to FIG. 5.

Mirror assembly 140 may be attached to the elongated member 120 and may include multiple mirrors that are configured to extend around an object being groomed. The height of the mirror assembly 140 may be adjusted to align with the target object being groomed. The target object may be any portion of a user's body such as a head, torso, shoulders, other body portion (e.g., body part) or a combination thereof. The height may be adjusted depending on the user's position, which may be a standing position, a sitting position, other position, or a combination thereof. Mirror assembly 140 will be discussed in more detail below in regards to FIGS. 3 and 4.

Figure 2:
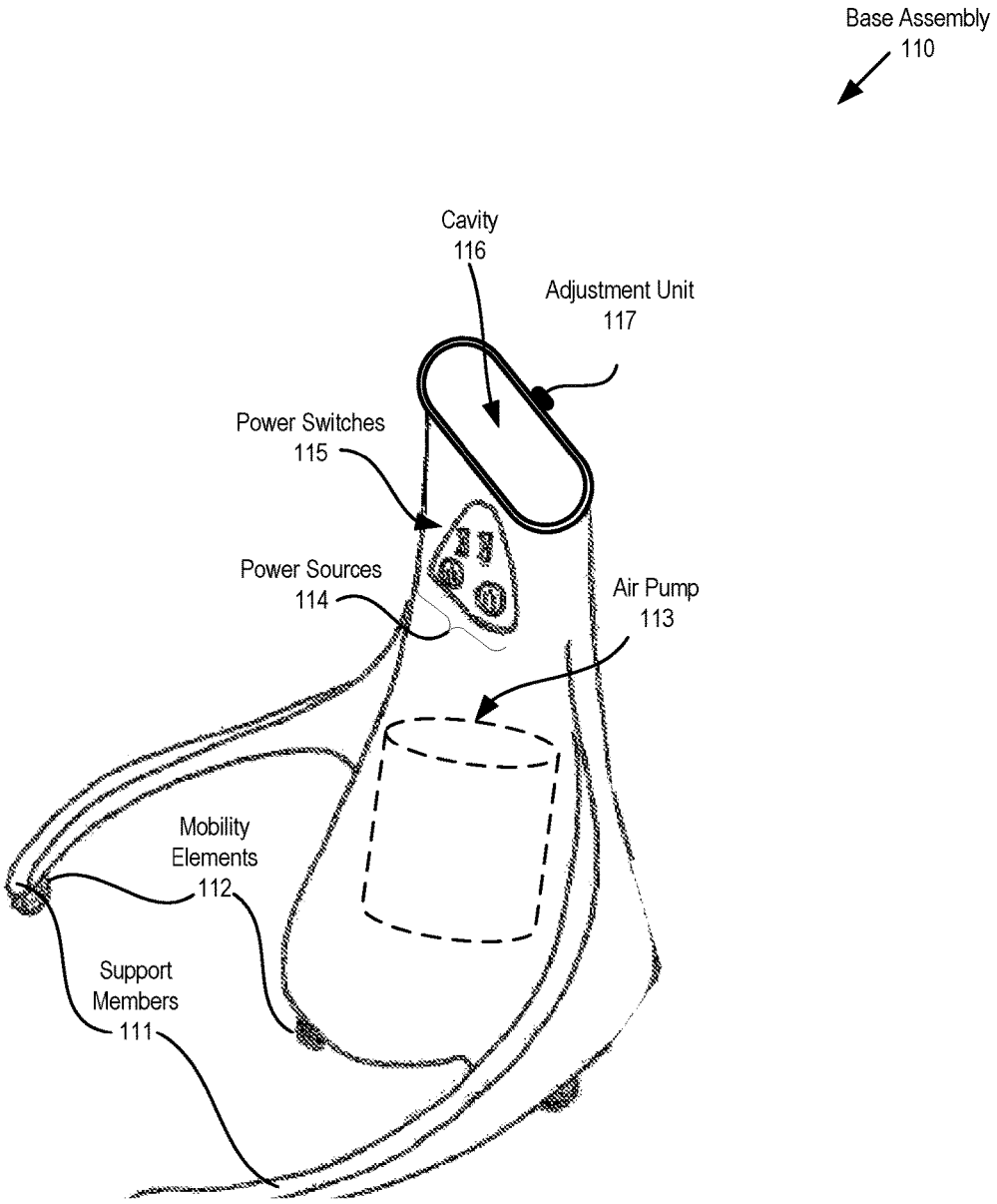
FIG. 2 illustrates an expanded view of base assembly in accordance with an embodiment.

FIG. 2 illustrates an expanded view of base assembly 110. Base assembly 110 may include support members 111, mobility elements 112, air pump 113, power outlets 114, power switches 115, a cavity 116, and an adjustment unit 117.

Support members 111 may be any structural member associated with the base assembly that is capable of interfacing with a support area. The support area may be any surface capable of sustaining the weight of the barber station apparatus. The support area may be an interior surface (e.g., floor, wall) or may be an exterior surface (e.g., ground) and may be horizontal, vertical, angled, or a combination thereof. In one example, the support area may be substantially horizontal and may be an interior surface of a building such as a floor (e.g., bathroom floor, garage floor). In another example, the support area may be substantially vertical such as a wall in which case the support members 111 may be mounted to the support area.

Mobility elements 112 may include mechanical structures that enable the base station to move along the support area. Mobility elements 112 and may be located on any portion of base assembly, such as the bottom portion, side portion, top portion, or on one or more of the support members 111. Mobility elements 112 may include one or more wheeled devices (e.g., casters), sliding devices (e.g., gliding disc), other device, or a combination thereof.

Air pump 113 may be integrated with base assembly 110. Air pump 113 may be located in or partially in the interior portion of base assembly and may be configured for suction, expulsion, or a combination thereof. When the air pump is configured for suction, it may function the same as or similar to a vacuum cleaner and may be used to vacuum portions of grooming byproduct (e.g., cut hair). When the air pump is configured for expulsion, the air pump may function the same as or similar to a hair dryer and may blow hot or cold air toward the target object.

Power source 114 may be positioned on an exterior portion of the base assembly and may be accessible by a user and configured to provide energy to one or more hair grooming devices. Power source 114 may include one or more of a power outlet, a charging contact, or an inductive charging point. In the example shown in FIG. 2, power source 114 may include multiple adjacent power outlets that are externally accessible and positioned in the upper portion of the base assembly 110. In other examples, power source 114 may have more or less power sources and they may be located at different portions of base assembly 110.

Power switches 115 may include control units for activating power to one or more of the features of the barber station apparatus. The features may include the power sources 114, the air pump 113, illumination devices, other features, or a combination thereof. In the example shown in FIG. 2, power switches 115 may include two adjacent power switches that are positioned directly above power sources 114. A first switch (e.g., left switch) may control power to the first power source (e.g., power outlet for hair clippers) and the second switch (e.g., right switch) may control the power to the air pump for activating or deactivating the air pump.

Cavity 116 may located in an upper portion of the base assembly and may be adapted to receive the elongated member. The cavity may have a shape that is the same or similar to the shape of the elongated member and may have a depth that can accommodate a portion of the elongated member.

Adjustment unit 117 may be configured to couple the elongated member with the base assembly and may enable a user to adjust the position of the elongated member relative to the base assembly. Adjustment unit 117 may include notches, holes, tabs, springs, bolts, pins, or other complementary aspects to enable the elongated member to be adjustably coupled to the base assembly. Adjustment unit 117 may enable the user to initiate the retraction of the elongated member into cavity 116 of base assembly 110. Adjustment unit 117 may be located at any location on base assembly 110, elongated member, other location, or a combination thereof. In the example shown in FIG. 2, adjustment unit 117 may be located adjacent to cavity 116. In other examples, adjustment unit 117 may be located in a lower portion of the base assembly and in either option there may be an externally accessible interface (e.g., adjustment knob).

Figure 3:
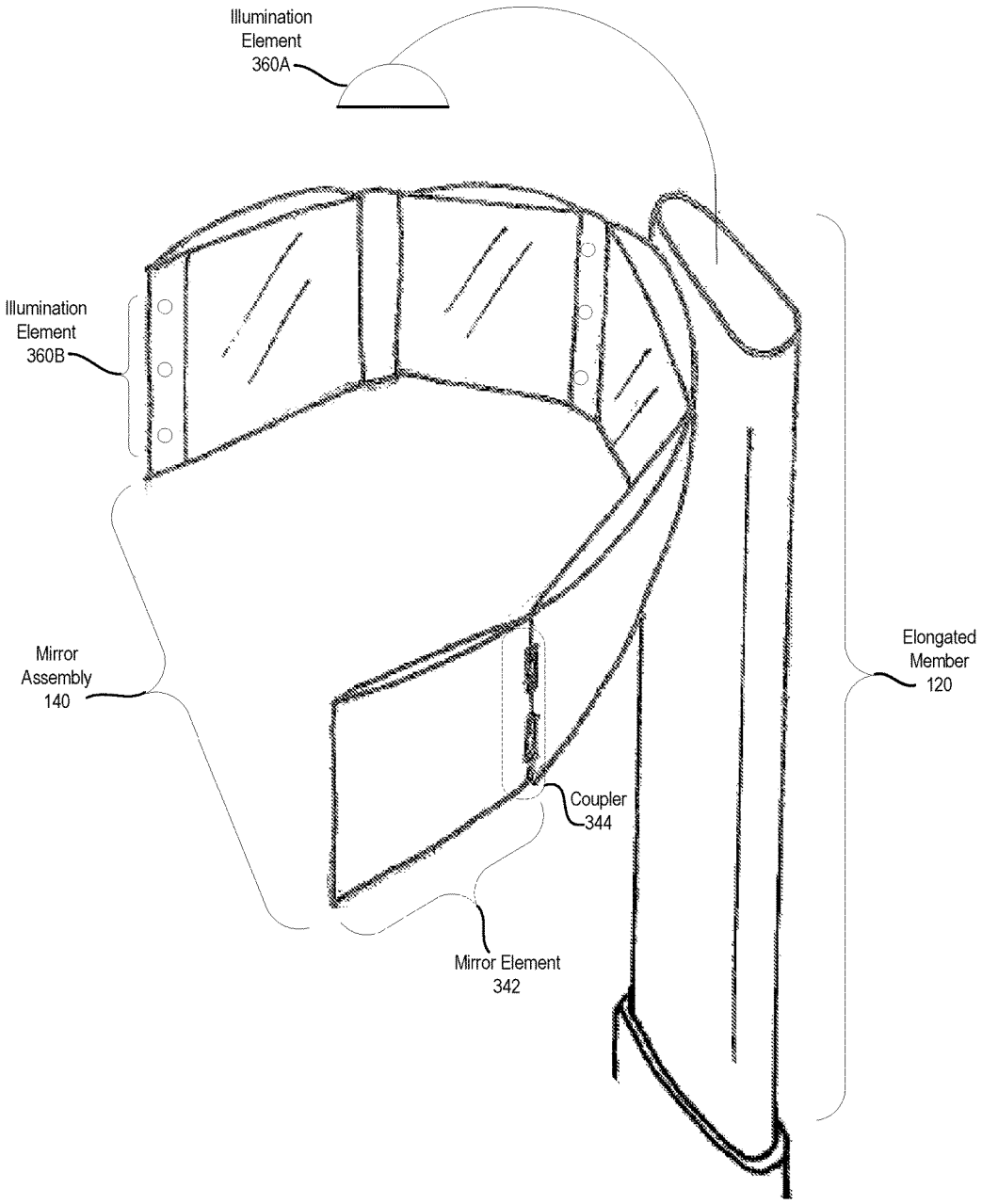
FIG. 3 illustrates an expanded view of elongated member, exemplary mirror assembly, and one or more illumination elements in accordance with an embodiment.

FIG. 3 illustrates an expanded view of elongated member 120, exemplary mirror assembly 140, and one or more illumination elements 360A and 360B. Elongated member 120 may function as a post element that supports mirror assembly 140 and may have two ends. A first end (e.g., bottom end) may be coupled to the adjustment unit of the base assembly and the second end (e.g., top end) may be coupled to mirror assembly 342.

Mirror assembly 140 may include multiple mirror elements 342 that are adjusted or arranged in a manner that enables a user to see multiple portions of a target object. The target object may be a portion of the user's body, such as the user's head, shoulders, torso, back, other body part or portion, or a combination thereof. The mirror assembly 140 may be arranged in a manner that enables an image of the target object to reflect off one or more mirror elements 342 before reaching the eyes of the user.

Each of the mirror elements 342 may include a portion that is reflective and a portion that is structural (e.g., a frame). The reflective portion may reflect light in a manner that preserves the detailed physical characteristics of the original light. The reflective portion may include plane mirrors with flat reflective surfaces or curved mirrors with curved reflective surfaces (e.g., concave or convex). The structural portion of the mirror element 342 may include a frame, back plate, or other supportive element. The structural portion of a first mirror element may be interconnected to one or more structural portions of a second or third mirror element via a coupler 344.

Coupler 344 may be any material, substance, or device that enables mirror elements 342 to move with respect to one another. The movement may be a rotational movement (e.g., pivoting), linear movement (e.g., side to side, up and down), circular movement (e.g., 3 dimensional rotation), other movement, or a combination thereof. In the example shown in FIG. 3, the coupler 344 may include one or more hinging members that enable a first mirror element to pivot with respect to a second mirror element. In other examples, the coupler may be a pin and socket configuration as shown in FIG. 4B. In yet another example, coupler 344 may be made of a material that enables it to be flexible and may keep its position once flexed.

Couplers 344 may enable mirror assembly to be expanded and retracted for storage or use. Couplers 344 may enable mirror elements 342 to expand in a peripheral direction such that mirror elements 342 extend around a portion of a target object (e.g., user's head). The mirror elements 342 may extend up to and over 180° around the target object. In one example, the mirror elements 342 may be arranged in a manner that provides a user a 360° view of a portion of the user's body (e.g., head). In another example, the mirror element 343 may be arranged in a manner that provides a user less than 360° view (e.g., 180°) but the user can rotate (turn left or right) to see the remaining portion of the user's body. Couplers 344 also enable the mirror elements 342 to be retracted for storage, which may be external and/or internal to the elongated member 120. In the example, shown in FIG. 3, mirror elements 342 may be retracted and stored external to the elongated member by rotating or pivoting at couplers 344. This may enable the five mirror elements 342 to be folded into one or more stacks. In one example, the stack may hide and protect the reflective portions of the mirror elements. In another example, the mirror elements may also be stored internally be retracting into the elongated member and will be discussed in more detail below in regards to FIG. 4A-C.

Illumination devices 360A and 360B may include any device that is capable of providing light on a target object. Illumination device 360A and 360B may provide light using any mechanism such as light bulbs (incandescent, fluorescent), light emitting diodes (LEDs, OLEDs), lasers, other light source or a combination thereof. Illumination devices 360A and 360B may be coupled to the elongated element 120, the mirror assembly 140, the base assembly, other portion of the barber station apparatus, or a combination thereof. In the example, shown in FIG. 3, illumination device 360A may be a light source (e.g., lamp) that is attached to the end of the elongated element that is remote from the base assembly. The light source may hang over a target object to illuminate the target object. In the example shown in FIG. 3, illumination device 360B may be a light source (e.g., LED light bar) that is integrated within one or more of the mirror elements 343. The light bar may be adjacent to the mirror portion and may be above, below, or to the side of the mirror portion.

Figure 4A:
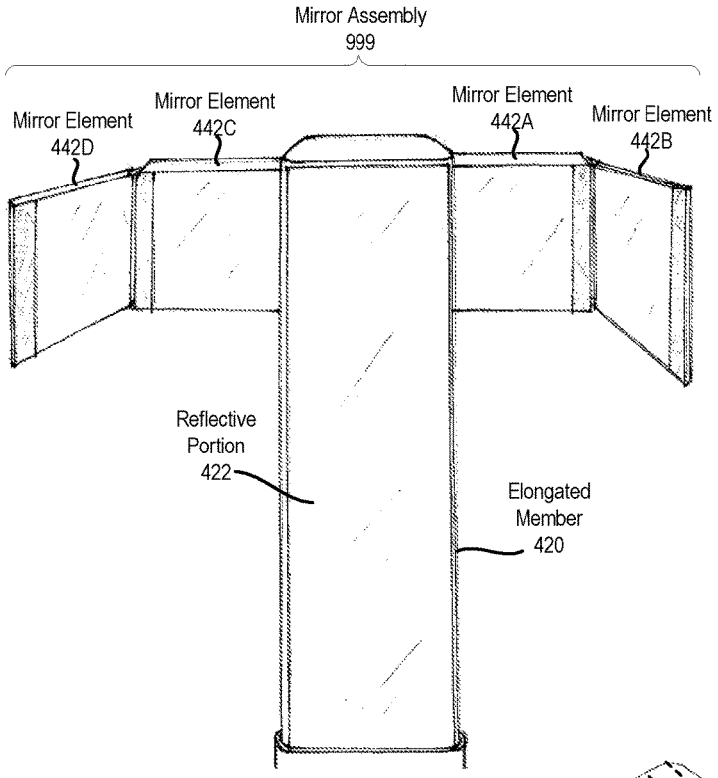
FIG. 4A illustrates alternate examples of the elongated member and the mirror assembly in accordance with an embodiment.
Figure 4B:
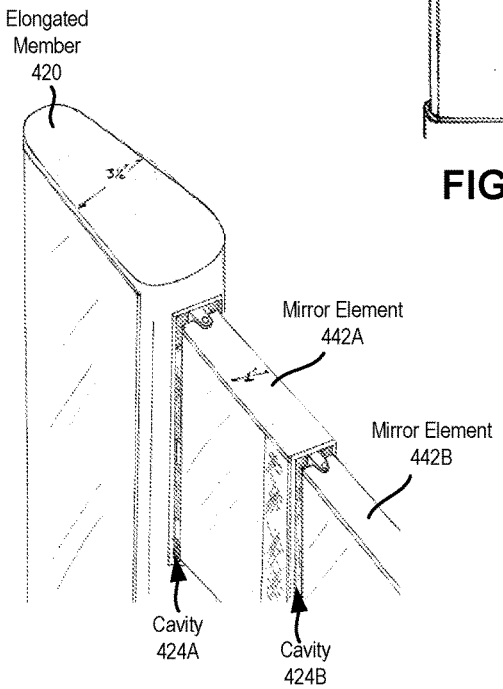
FIG. 4B illustrates a mirror assembly with nested mirror elements in accordance with an embodiment.
Figure 4C:
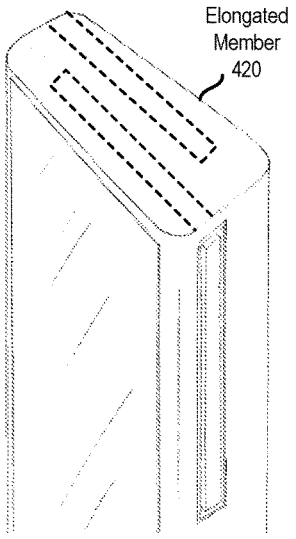
FIG. 4C illustrates the elongated member with the nested mirror elements retracted within the elongated member in accordance with an embodiment.

FIGS. 4A-4C illustrate alternate examples of an elongated member and a mirror assembly in accordance with one aspect of the disclosure. With reference to FIG. 4A, elongated member 420 may be similar to elongated member 120 and may include a reflective portion 422 extending along the side of elongated member 420 that is closest to the target object (e.g., front face). In one example, reflective portion 422 may function as a mirror element for mirror assembly 440. Referring to FIG. 4B, mirror elements 442A and 442B may be configured in a nested arrangement. The nested arrangement may comprise a cavity 424A in the elongated member 420 and cavities in one or more of the mirror elements. Cavity 424A may be adapted to fit mirror element 442A and mirror element 442A may include cavity 424B that may be adapted to fit mirror element 442B. The nested arrangement may be expanded or retracted by applying a force (e.g., pull, push) to the mirror elements to push them into the elongated member or to pull them from the elongated member. The force may be provided by a user or may be provided by a spring, magnet, motor, or other device before, after, or during the receipt of user input. Referring to FIG. 4C, elongated member 420 may have two separate cavities that are adjacent to one another but open up to opposite sides of the elongated member 420. The separate cavities may provide a location to store mirror elements to the left (442A-B) and right (442C-D) respectively.

Figure 5:
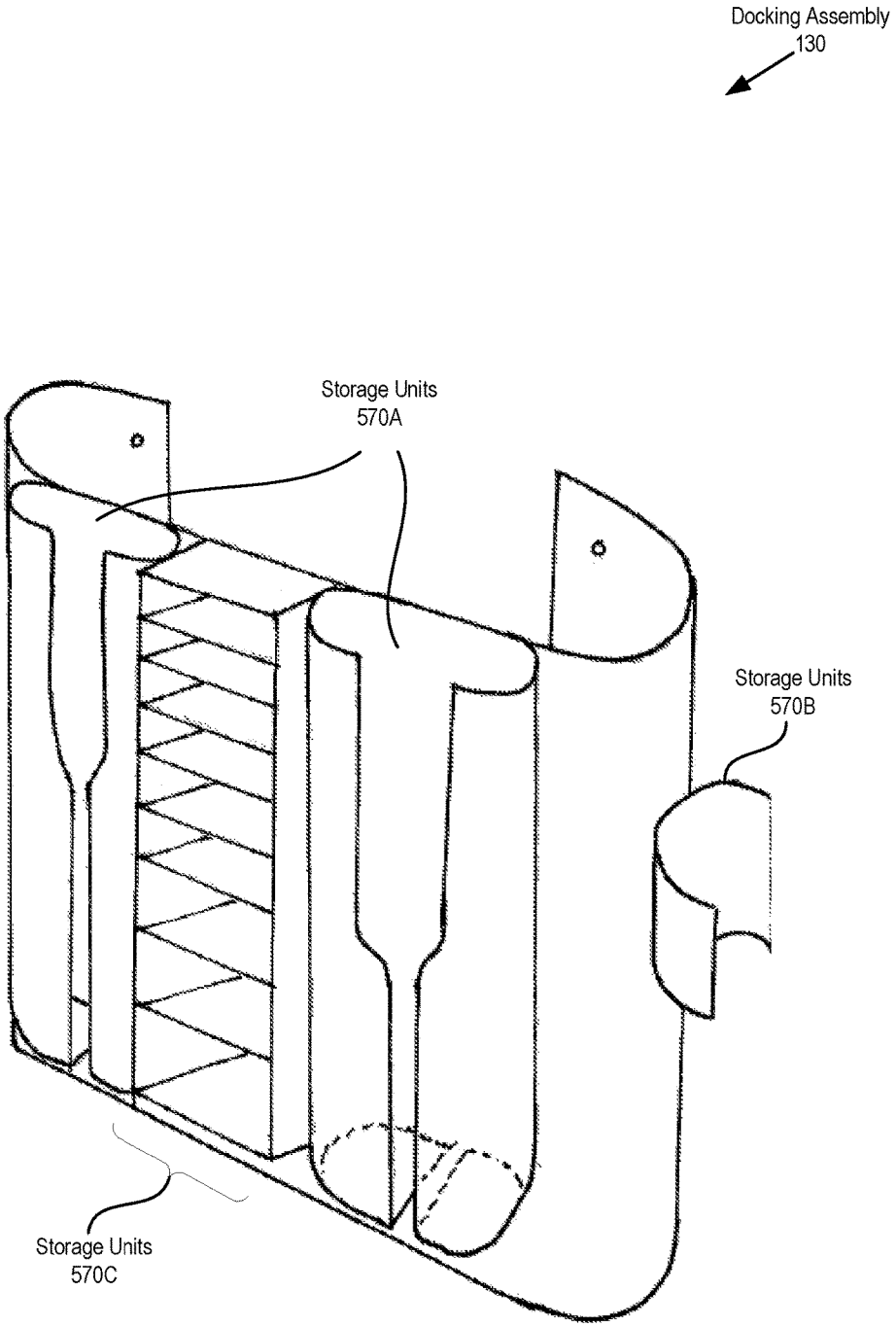
FIG. 5 illustrates an expanded view of the docking assembly in accordance with an embodiment.

FIG. 5 illustrates an expanded view of docking assembly 130 in accordance with one aspect of the disclosure. Docking assembly 130 may include one or more storage units 570A-C and may be coupled to the elongated member, the base assembly, other object, or a combination thereof. Storage units 570A-C may provide a covered, surrounded, or exposed areas that can be used to store one or more barber objects. Barber objects may include electrical devices (e.g., hair clippers, hair dryer), mechanical devices (e.g., scissors, spray bottle, brush, comb), items (e.g., vacuum tubes, attachments), products (e.g., hair gel, hair dye, hair spray), other objects, or a combination thereof.

Storage units 570A may be configured to conform to a particular barber object and may surround some or all of a particular barber object when placed within storage unit 570A. In the example shown in FIG. 3, storage units 570A may conform to a barber object (e.g., hair clippers) and may wrap around the barber object and support the weight of the object from below and from the sides. Storage units 570A may be configured with a continuous slot that extends from a first side (e.g., front) to a second side (e.g., bottom) of storage unit 570A and enables the barber object to enter the storage unit from the top or side and allows the power cord of the barber object to pass through the sides of the storage without disconnecting the power cord from the barber object. In one example, storage area 570A may include one or more integrated power sources (e.g., recharging points) and may be capable of supplying energy to a barber object (e.g., rechargeable hair clippers).

Storage unit 570B may be similar to storage units 570A and may be configured to conform to a particular barber object but may exclude a bottom portion. In the example shown in FIG. 3, storage unit 570B is configured to receive a barber device (e.g., vacuum tube) and conforms to and applies pressure to the outer perimeter of the barber object without providing a bottom portion.

Storage units 570C may include one or more compartments for storing barber objects. The compartments may be organized and adjusted by the user to alter the quantity of individual compartments or the size of one or more of the compartments. In the example shown in FIG. 3, storage units 570C are located between storage units 570A but in other examples, they may be located anywhere on or within docking assembly 130.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to utilize the invention and various embodiments with various modifications as may be suited to the particular use contemplated.

What is claimed is:

1. A barber station apparatus comprising:

a base assembly;

a mirror assembly comprising a plurality of mirror elements adapted to extend around a target object;

an elongated member coupled to the base assembly and to the mirror assembly, wherein the elongated member comprises a cavity to store one or more of the plurality of mirror elements; and a docking assembly coupled to the elongated member and configured to receive one or more hair grooming devices.

2. The barber station apparatus of claim 1, wherein the plurality of mirror elements to provide a 360° view of the target object.

3. The barber station apparatus of claim 1, wherein the plurality of mirror elements are coupled by a hinging member, wherein the hinging member enables the mirror elements to pivot.

4. The barber station apparatus of claim 3, wherein the hinging member enables the mirror assembly to fold.

5. The barber station apparatus of claim 1, wherein the elongated member comprises the plurality of mirror elements in a nested arrangement, wherein the nested arrangement comprises a first mirror element stored within a cavity of a second mirror element and the second mirror element stored in the cavity of the elongated member.

6. The barber station apparatus of claim 1, wherein the hair grooming devices comprise one or more of hair cutting devices, hair styling devices, hair drying devices, or hair coloring devices.

7. The barber station apparatus of claim 1, wherein the base assembly further comprises a power source configured to provide energy to the one or more hair grooming devices, wherein the power source comprises one or more of a power outlet, a charging contact, or an inductive charging point.

8. The barber station apparatus of claim 1, wherein the elongated member comprises a reflective portion that functions as one of the plurality of mirror elements.

9. The barber station apparatus of claim 1, further comprising an air pump integrated with the base assembly, wherein the air pump comprises a suction pump.

10. The barber station apparatus of claim 1, further comprising an illumination element attached to an end of the elongated member, wherein the end is opposite the base assembly.

11. The barber station apparatus of claim 1, further comprises an illumination element that is integrated with one or more of the plurality of mirror elements.

12. The barber station apparatus of claim 1, wherein the docking assembly is attached to the elongated member and is further configured to receive one or more attachments.

13. The barber station apparatus of claim 1, wherein the base assembly comprises a cavity to store a portion of the elongated member.

14. The barber station apparatus of claim 1, wherein the elongated member is adjustably coupled to the base assembly using an adjustment unit comprising a bolt or pin.

15. The barber station apparatus of claim 1, wherein the base assembly comprises one or more mobility elements, the mobility elements comprising a wheeled device or a sliding device.

16. The barber station apparatus of claim 1, wherein the base assembly comprises a stability member, and wherein the stability member and the mirror assembly are configured to extend around a user.

17. The barber station apparatus of claim 1, wherein the docking assembly comprises a charging contact.

18. The barber station apparatus of claim 1, wherein the docking assembly comprises a storage unit.

19. A barber station apparatus comprising:

a base assembly comprising an air pump, wherein the air pump is integrated with the base assembly and comprises a suction pump;

an elongated member coupled to the base assembly;

a mirror assembly coupled to the elongated member, the mirror assembly comprising a plurality of mirror elements adapted to extend around a target object; and a docking assembly coupled to the elongated member and configured to receive one or more hair grooming devices.

20. A barber station apparatus comprising:

a base assembly;

an elongated member coupled to the base assembly, the elongated member comprising an illumination element attached to an end of the elongated member, wherein the end is opposite the base assembly;

a mirror assembly coupled to the elongated member, the mirror assembly comprising a plurality of mirror elements adapted to extend around a target object; and a docking assembly coupled to the elongated member configured to receive one or more hair grooming devices.

* * * * *